US006298639B1

(12) United States Patent
Shea

(10) Patent No.: US 6,298,639 B1
(45) **Date of Patent: *Oct. 9, 2001**

(54) METHOD AND ASSOCIATED APPARATUS FOR IMPARTING A HELICAL CURL RIBBON MATERIAL FOR MAKING A DECORATIVE ELEMENT

(75) Inventor: Scott Shea, Berwick, PA (US)

(73) Assignee: Berwick Industries, Inc., Wilmington, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/074,677

(22) Filed: May 8, 1998

(51) Int. Cl.[7] ..... B65B 63/00

(52) U.S. Cl. ..... 53/520; 53/136.1; 223/46

(58) Field of Search ..... 223/46; 493/459, 493/460, 462; 53/520, 522, 136.1

(56) References Cited

U.S. PATENT DOCUMENTS

| | | | |
|---|---|---|---|
| 1,652,855 | 12/1927 | Fernandez . | |
| 1,773,580 | 9/1930 | Franke . | |
| 2,226,181 | 12/1940 | Ridderstron . | |
| 2,384,462 | 9/1945 | Goodman . | |
| 2,393,058 | 1/1946 | Pierce et al. | 18/19 |
| 2,649,393 | 8/1953 | Cumming . | |
| 2,669,913 | 2/1954 | Cerone . | |
| 2,880,540 | 4/1959 | Williams . | |
| 3,143,456 | 8/1964 | McGrath et al. . | |
| 3,159,873 | 12/1964 | Mylo et al. | 18/1 |
| 3,256,129 | 6/1966 | Wallerstein et al. . | |
| 3,327,915 | 6/1967 | Lubin . | |
| 3,396,880 * | 8/1968 | Kiota | 223/46 |
| 3,575,289 | 4/1971 | Brousse . | |
| 3,591,434 | 7/1971 | Hartstein . | |
| 3,637,452 | 1/1972 | Sanders . | |
| 3,681,912 | 8/1972 | Silverman | 57/157 |
| 3,832,841 | 9/1974 | Cole . | |
| 3,962,957 | 6/1976 | Hinzmann . | |
| 3,996,842 | 12/1976 | Ehlich et al. . | |
| 4,025,878 | 5/1977 | Predmore | 333/10 |
| 4,044,501 | 8/1977 | Frydryk . | |
| 4,080,242 | 3/1978 | Komenda et al. . | |
| 4,138,048 | 2/1979 | Lemmon . | |
| 4,138,049 | 2/1979 | McAlarney . | |
| 4,182,738 | 1/1980 | Casaert et al. | 264/210.2 |
| 4,201,806 | 5/1980 | Cole . | |
| 4,281,854 | 8/1981 | Savich . | |
| 4,324,827 | 4/1982 | Obayashi et al. . | |
| 4,388,264 | 6/1983 | Leuvelink | 264/281 |

(List continued on next page.)

FOREIGN PATENT DOCUMENTS

| | | |
|---|---|---|
| 3421175A1 | 12/1985 | (DE) . |
| WO911617 | 10/1991 | (WO) . |

*Primary Examiner*—Eugene L. Kim
(74) *Attorney, Agent, or Firm*—Seidel, Gonda, Lavorgna & Monaco, PC

(57) ABSTRACT

This invention provides a method and associated apparatus in which decorative ribbons of varying thickness, width, and material can be automatically produced, curled, grouped, and combined in a decorative element which is packaged for distribution. The apparatus serves to impart a helical curl to at least one of a plurality of ribbon strands, meters the strands into preselected lengths, separates the lengths from the ribbon stock, and packages the resulting coiled ribbon arrangements for distribution to customers. The apparatus includes one or more roll stands for storing rolls of ribbon stock, a feed unit for advancing the ribbon through the apparatus and imparting a tendency to curl the strands, a tension regulator unit for accumulating metered lengths of the stands and regulating the advancement of the ribbon strands through the apparatus, and a packaging unit for attaching the ribbon on a placard, to form a decorative element having a cluster of curled ribbon strands.

27 Claims, 4 Drawing Sheets

U.S. PATENT DOCUMENTS

| | | | | |
|---|---|---|---|---|
| 4,449,652 | | 5/1984 | Coppins et al. . | |
| 4,528,833 | * | 7/1985 | Inaike et al. | 493/459 |
| 4,532,169 | | 7/1985 | Carley . | |
| 4,681,723 | | 7/1987 | Jester . | |
| 4,713,267 | | 12/1987 | Truskolaski . | |
| 4,721,122 | | 1/1988 | Sahm | 132/9 |
| 4,798,754 | | 1/1989 | Tomek . | |
| 4,851,275 | | 7/1989 | Yes . | |
| 4,884,583 | | 12/1989 | Long, Jr. | 132/238 |
| 4,884,826 | | 12/1989 | Slagsvol . | |
| 4,915,996 | | 4/1990 | Curry . | |
| 4,919,980 | | 4/1990 | Pirkey . | |
| 4,952,281 | | 8/1990 | Akira . | |
| 4,968,540 | | 11/1990 | Linsenbigler . | |
| 4,980,922 | | 12/1990 | Spargo, Sr. . | |
| 5,004,144 | | 4/1991 | Selga . | |
| 5,036,590 | | 8/1991 | Reinke et al. . | |
| 5,072,865 | * | 12/1991 | Lyons | 223/46 |
| 5,120,296 | | 6/1992 | Yamaguchi et al. . | |
| 5,122,211 | | 6/1992 | Roach | 156/173 |
| 5,154,688 | | 10/1992 | Boyd . | |
| 5,156,893 | | 10/1992 | Barthe . | |
| 5,192,261 | | 3/1993 | Honjo et al. | 493/29 |
| 5,205,007 | | 4/1993 | Goldstein | 7/135 |
| 5,232,132 | | 8/1993 | Broussard et al. . | |
| 5,257,492 | | 11/1993 | Watts . | |
| 5,261,578 | * | 11/1993 | Monahan | 223/46 |
| 5,297,705 | * | 3/1994 | Schmidt | 223/46 |
| 5,316,539 | * | 5/1994 | Leemhuis et al. | 493/459 |
| 5,334,128 | | 8/1994 | Carrico et al. | 493/439 |
| 5,383,837 | | 1/1995 | Watts . | |
| 5,395,469 | | 3/1995 | Suggs, Jr. et al. | 156/173 |
| 5,400,452 | | 3/1995 | Goldstein . | |
| 5,407,417 | | 4/1995 | Goldstein . | |
| 5,411,774 | * | 5/1995 | Weder | 223/46 |
| 5,470,620 | | 11/1995 | Weder . | |
| 5,484,496 | * | 1/1996 | Hackenberg | 223/46 |
| 5,518,492 | | 5/1996 | Goldstein . | |
| 5,551,646 | | 9/1996 | Goldstein | 242/419 |
| 5,564,145 | | 10/1996 | Goldstein | 7/158 |
| 5,711,752 | | 1/1998 | Goldstein . | |
| 5,916,081 | | 6/1999 | Goldstein | 493/459 |

* cited by examiner

METHOD AND ASSOCIATED APPARATUS FOR IMPARTING A HELICAL CURL RIBBON MATERIAL FOR MAKING A DECORATIVE ELEMENT

FIELD OF THE INVENTION

The present invention relates to the automated manufacture of decorative elements for the adornment of packages and the like, and more particularly to a novel method of imparting a curl to one or more ribbon strands for incorporation in the decorative elements.

BACKGROUND OF THE INVENTION

Decorative elements such as ribbons and bows are commonly affixed to packages, gifts, and the like. Often times, these decorative elements serve as a reminder of a particular holiday, event, or simply serve as a personal expression of one's thoughtfulness. Indeed, a carefully packaged, decorative gift wrapping is increasingly recognized as a desirable component of any personal, family, or holiday celebration. As such, the degree of perceived originality or creativity in the design of such packaging ornaments is a key component of the commercial appeal of these items to the buying public.

In response to consumer demand for increased selection and originality in ribbon designs, manufacturers have introduced hand-made ribbon arrangements. These arrangements are multicolored ribbons of varying width, thickness, patterns, and colors which are hand wound, packaged, and sold individually. The ribbon arrangement is processed by hand to impart a curl to the material, resulting in a pleasing combination of grouped sections of multicolored helically coiled ribbons. Typically, the curl in a flat ribbon is created by running the length of the ribbon materials across a sharp edge.

The hand-made ribbons are packaged by attaching the ribbon arrangement to a cardboard placard for positioning on a retail display. Upon purchase, the ribbon is detached from the packaging and affixed to a gift box by way of an adhesive included on the underside of the ribbon arrangement or placard, typically double face tape.

Yet, while aesthetically appealing, hand made ribbons are cost prohibitive for many consumers. Consumers have grown accustomed to machine produced ribbons which are less expensive due to the lack of manual labor required for their creation. Heretofore, attempts at automating the curling process is frustrated by the varying materials, widths, and thicknesses commonly encountered in the most desirable hand-made ribbons.

Therefore, currently a method and associated apparatus is desired in which decorative ribbons of varying thickness, width, and material can be produced, curled, grouped, and packaged for sale automatically and cost effectively.

SUMMARY OF THE INVENTION

A method and associated apparatus in which decorative ribbons of varying thickness, width, and material can be automatically produced, curled, grouped, and packaged for sale is provided. The apparatus includes one or more roll stands, a feed unit, a tension regulator unit, and a packaging unit. The apparatus imparts a helical curl to at least one of a plurality of ribbon strands, measures the strands into preselected lengths, separates the lengths from the ribbon stock, and packages the resulting coiled ribbon arrangements for distribution to customers.

The method of imparting the curl to the ribbon is accomplished through the application of controlled temperature to a ribbon strand advancing along an apparatus travel path. The ribbon is wound around a mandrel or curl tube as a helix and is heated to a predetermined temperature and cooled along the ribbon travel path to impart a curling tendency to the ribbon strand. The ribbon travel path spirals about the periphery of hollow threaded curl tubes such that apertures formed therein exhaust temperature-controlled air for imparting and setting a curl to the ribbon traveling around the tube.

The roll stand of the apparatus provides ribbon stock for supplying the apparatus with a plurality of ribbon materials of varying dimension, styles, and colors. The ribbon is drawn off from the free spooling roll stand by the feed unit.

The feed unit draws the ribbon strands from the roll stand. Drive rollers of the feed unit frictionally engage the ribbon strands drawing them into the feed unit. The ribbon strands are drawn from the roll stand, and are fed by the drive rollers of the feed unit to a corresponding one of the curl tubes of the feed unit. The curl tubes put a helical curl in the ribbon strands, and temperature-controlled air is provided for setting the curl in the ribbon strands. The ribbon strands exit the feed unit passing to the tension unit.

The tension regulator unit is provided to regulate the tension in the exiting ribbon strands and control rotation of the drive rollers of the feed unit. At its exit end, the tension regulator unit stacks multiple strands of the flat ribbon in face-to-face contact, and passes a group of ribbon strands to the packaging unit in a single vertical stack.

The packaging unit clamps, automatically arranges, and secures the curled ribbon strands onto a placard for distribution to customers, dropping the packaged ribbon product to a conveyor belt for shipping.

Still other benefits and advantages of this invention will become apparent to those skilled in the art upon a reading and understanding of the following detailed specification and related drawings.

BRIEF DESCRIPTION OF THE DRAWINGS

The foregoing summary, and the following detailed description, will be best understood when reads in conjunction with the attached figures, in which.

DESCRIPTION OF THE PREFERRED EMBODIMENT

Figure 2:
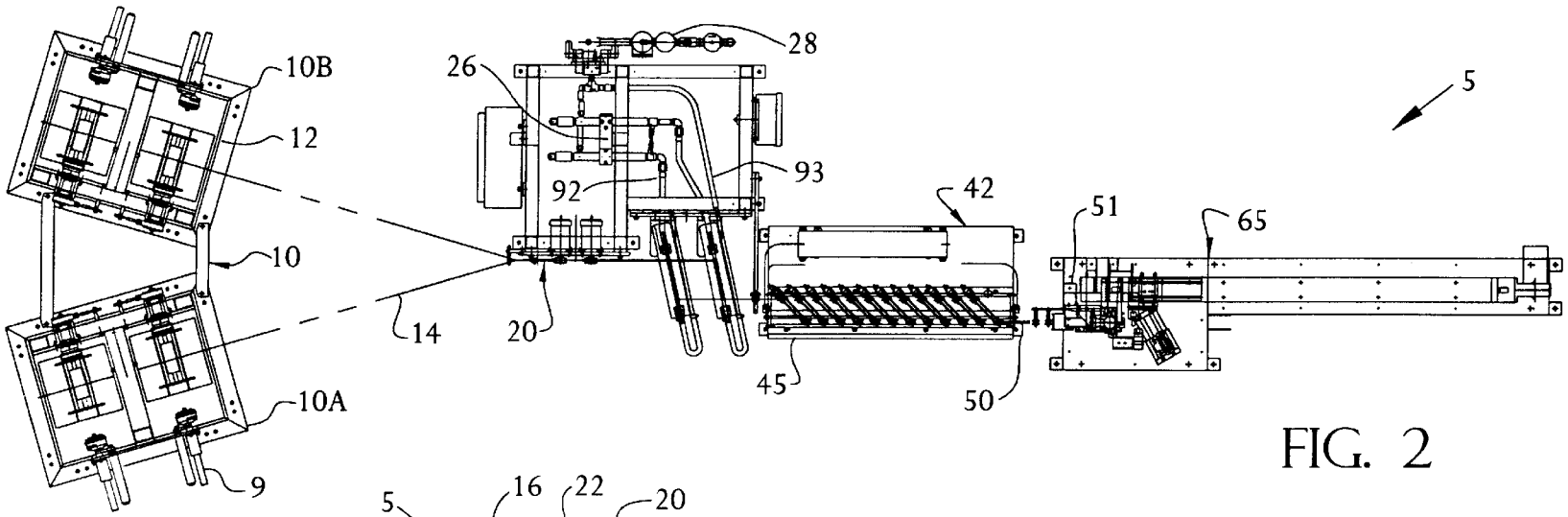
FIG. 2 is a top view of the apparatus illustrated in FIG. 1.
Figure 1:
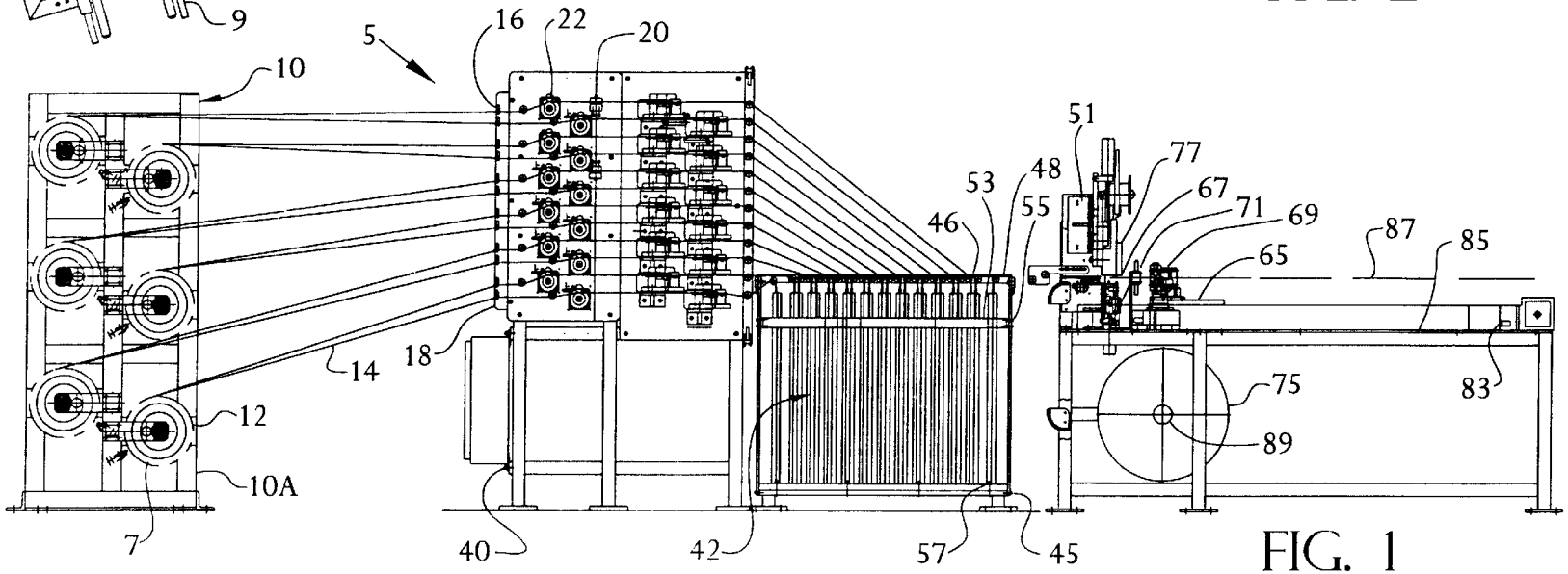
FIG. 1 is a side view of the apparatus of the present invention.
Figure 3:
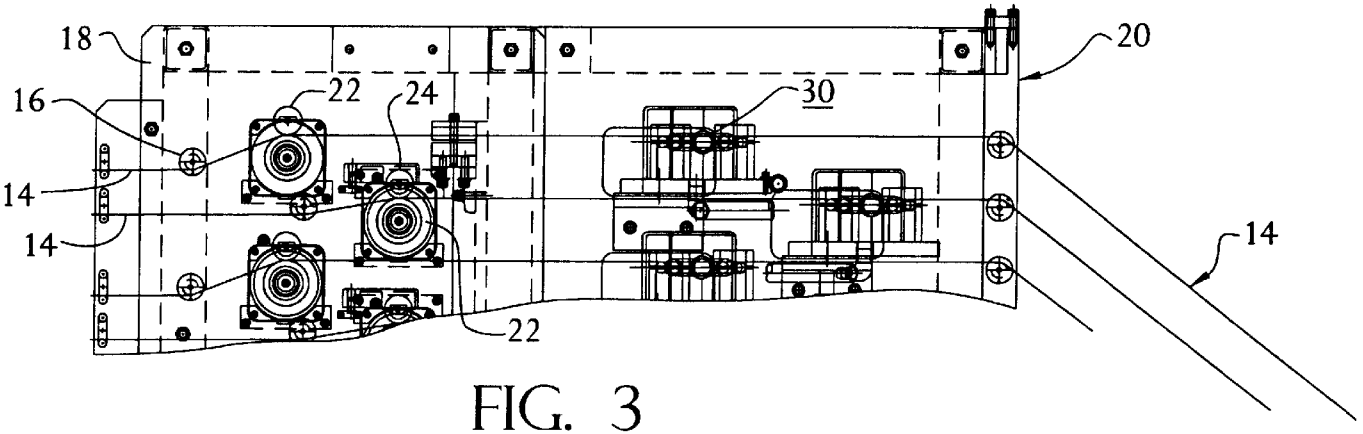
FIG. 3 is an enlarged fragmentary view of the apparatus illustrated in FIG. 1, showing the ribbon feed-drive in the feed unit for the uppermost strands of ribbon.

Referring to FIGS. 1 and 2, the apparatus is shown at 5 and comprises a ribbon supply station 10 which mounts a plurality of ribbon spools 7 containing strands of ribbon 14 for feeding to a feed unit 20.

The feed unit 20 constitutes curling apparatus having drive rollers 22 for withdrawing strands of ribbon from the supply and advancing each strand to a curling tube 30. The ribbon is wrapped around the curling tube 20 in a helical path 38 having two parts. In the first part, the strand of ribbon is heated while in the helical configuration and in the second part, the strand is cooled while in the same helical configuration, the heating and cooling of the ribbon strand imparting a tendency for the strand to curl.

From the curling tubes of the curling apparatus 20, the strands are fed to a tension regulator apparatus 42 which receives and accumulates a metered length of each strand discharged from the curling apparatus. Sufficient tension is applied to each strand in the tension regulator to resist the tendency of the strand to curl so that it travels through the tension regulator unit 42 without curling. At the discharge end of the tension regulator unit 42, the strands are stacked in face-to-face confronting relation at the feed end of a packaging unit 65.

The packaging unit 65 with a gripper 69 withdraws a predetermined length of the ribbons in the stack in two steps. At the end of the first step, a placard 99 is fed into registry with the stack at the feed end of the unit 65 and the stack of ribbons 14 are attached to the placard 99. After the attachment of the stack of ribbons to the placard, the second step of the withdrawal carries the placard away from the feed end of the packaging unit so that the placard is attached to a midpoint of the predetermined length of the stack extending from the gripper 69 to the feed end of the packaging unit 65. Thus, the stack of ribbons attached to the placard are severed from the ribbons emanating from the tension regulator unit, and the gripper is released to allow the individual strands attached to the placard to curl up and form a decorative element. The placard 99 with the curled ribbon strands attached thereto is incorporated in a package for distribution to customers.

As shown in FIG. 1, the ribbon supply station 10 comprises a pair of roll stands 10A and 10B in the form of a creel having a plurality of spindles 9 mounting individual spools 7 of flat ribbon. The roll stands 10A and 10B are angularly positioned on a frame 12 so as to provide unimpeded travel of the strands 14 to the feed unit 20 without tangling or chafing. Each ribbon strand 14 from the ribbon supply station 10 is threaded through the feed unit or curling apparatus 20.

As shown in FIGS. 1–4, the feed unit 20 has a pair of drive or feed rollers 22 for each of the strands 14. The drive rollers have a nip engaging the flat ribbon to withdraw the strand 14 from the supply station 10 and feed it to a curl tube 30. The feed rollers 22 are mounted on a rack 18 having guide posts 16 for directing the ribbon strands into the nip of the feed rollers. The guide posts 16 serve to separate the ribbon strands 14 and direct them to the feed rollers 22 without chafing or tangling. The feed rollers 22 are elastomeric so as to provide a firm grip of the ribbon as it passes into the nip therebetween. The number of feed roller sets 22 corresponds to the number of ribbon strands 14 so that each ribbon strand is positively fed from the ribbon supply to a curl tube. The feed rollers 22 are individually controlled by control circuits 24 under the control of the tension regulator 42, as described more fully hereinafter in connection with FIGS. 3 and 4.

Figure 4:
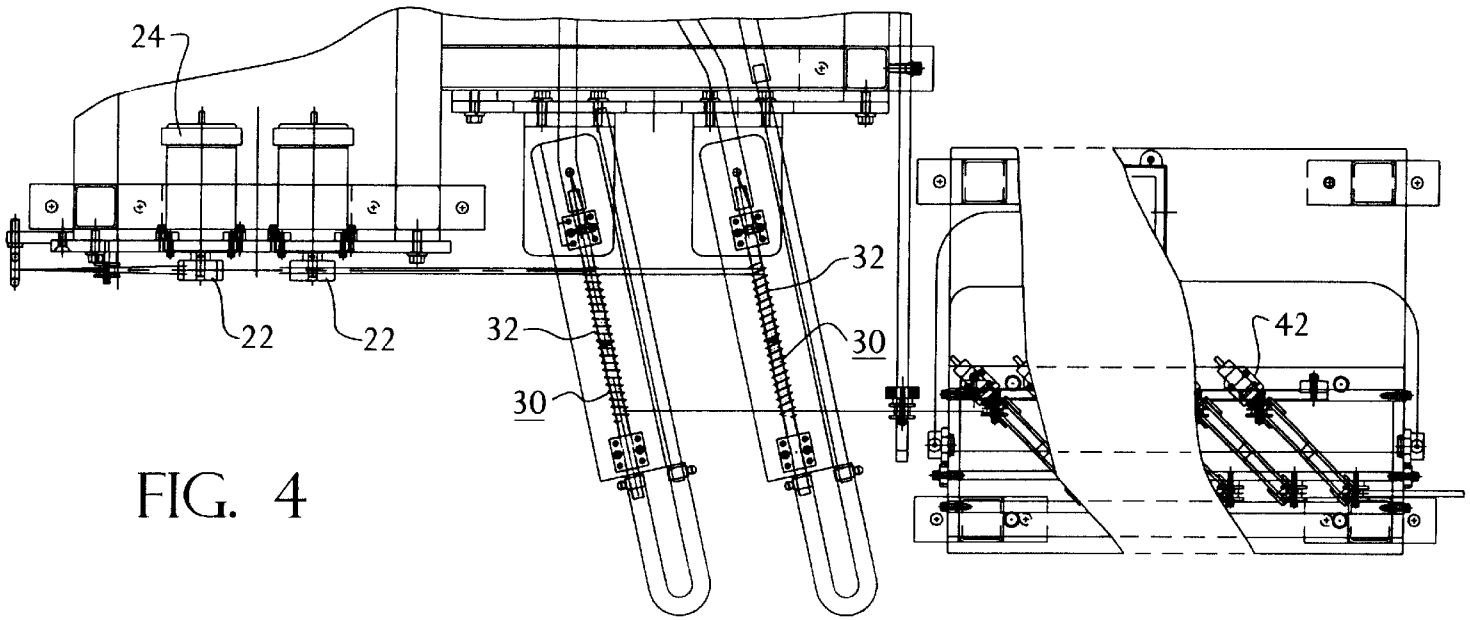
FIG. 4 is a fragmentary plan view of the apparatus illustrated in FIG. 3.

From the feed rollers 22, the ribbon strands are fed to curl tubes 30 having a fin 32 forming a helical guide path, such as a groove or channel 38 (see FIG. 5) around the external cylindrical periphery of the curl tube. As shown in FIG. 4, the curl tubes 30 are arranged in pairs, one of the tubes having a clockwise-wound fin 32 and the other having a counterclockwise-wound fin. The ribbon is directed onto the clockwise-wound tube over the top as shown in FIG. 4 and to the counterclockwise-wound tube to the underside. The helical curls set in the strands by the two tubes are of opposite hand, so as to cause their separation in the decorative element when activated in the packaging unit. Each ribbon strand is threaded within the guide path 38 (see FIG. 5) in contact with the outer cylindrical surface of the tube 30. After traveling the length of the helical path 38 formed between the fins 32, the ribbon strand is withdrawn into the tension regulator unit 42.

Preferably, the spacing between the fins 32 corresponds to the width of the widest strand of ribbon which is to be fed through the helical guide path 38. The maximum spacing of the fins will accommodate ribbons of any width up to the maximum. Inasmuch as the feed and curling unit accommodates 12 ribbon strands, if the supply of ribbons requires that the unit handle a predetermined arrangement of widths, the spacing between the fins may be accommodated to the individual widths of the ribbons. The ribbons have at least one flat face to ride on the cylindrical exterior surface of the curl tube 30 so as to maximize the heat transfer between the traveling ribbon and the curl tube.

When the ribbon travels in the helical path wrapped around the tube 30, it is subjected to first heating and then cooling, so as to create a tendency for the ribbon to curl into a helix conforming to the path. In the present instance, the heating and cooling of the ribbon strand is accomplished through the application of temperature-controlled air to the strand as it is advanced through the ribbon path 38.

Figure 5:
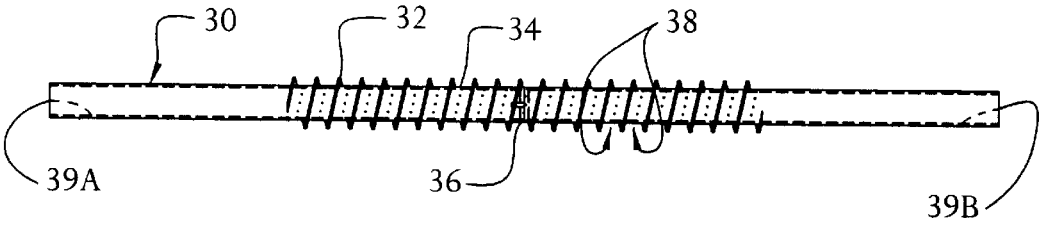
FIG. 5 is a plan view of the tension regulator unit of the apparatus illustrated in FIG. 1.

As shown in FIG. 5, the curling tube 30 is hollow and has a central plug 36 dividing the hollow interior of the tube into a lefthand and righthand chamber designated 39A and 39B respectively in FIG. 5. The tube is provided with apertures 34 between the fins 32 affording fluid communication between the hollow bores 39A and 39B with the helical path 38 defined between the fins 32. The plug 36 divides the helical path 38 into a first part overlying the bore 39A and a second part overlying the bore 39B. The bores 39A and 39B are supplied with temperature-controlled air by feed tubes 92 from an air heater 26 which directs heating air into the bore segments 39A of the plurality of curling tubes 30 in the feed and curling unit 20. Cooling air is supplied to the other end of the curling tubes in the bores 39B through feed tubes 93 so as to exhaust cooling air through the apertures 34 in the second part of the helical path. Thus, as the ribbon is advanced in the helical path around the cylindrical circumference of the tube, the ribbon is first subjected to heating by the heating air exhausted from the bore 39A and then is subjected to cooling air exhausted from the bore 39B, the flat ribbon being wrapped with its face in engagement with the cylindrical surface of the tube so as to assume a helical configuration. In the first part of the helical path, the ribbon strands are heated to a sufficiently high temperature to allow the ribbon to assume a helical set without destruction of the continuity of the ribbon. The helical set is fixed in the ribbon by the passage through the cooling part of the path 38. Air is supplied to the tube 93 and the heater 26 and tube 92 through an air supply having suitable filters as indicated at 28 in FIG. 2.

Figure 6:
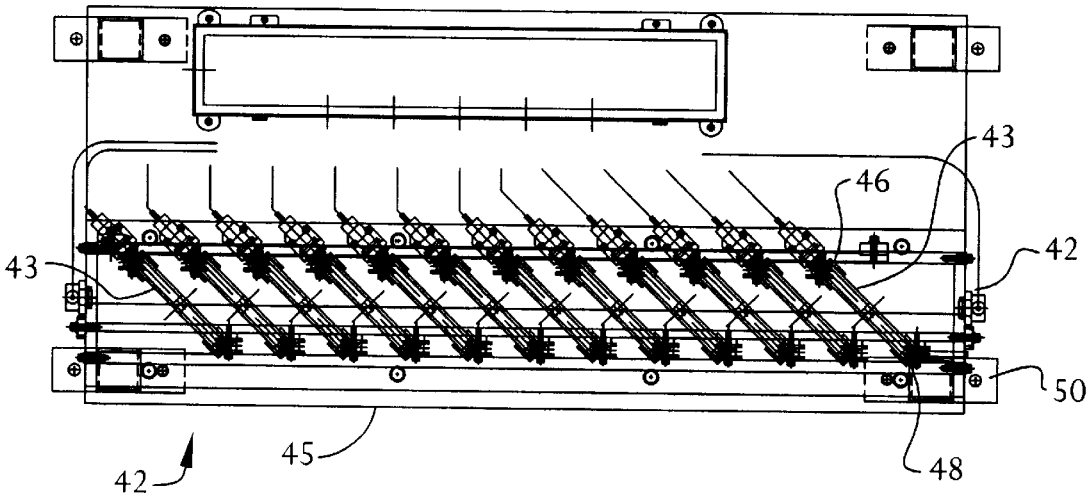
FIG. 6 is an enlarged side view of a curl tube of the feed unit of the apparatus illustrated in FIG. 1.

The ribbon strands 14 exiting from the remote ends of the curl tubes are advanced into the tension regulator unit 42 which serves to maintain sufficient tension on the ribbon to overcome the tendency of the ribbon to curl imparted by the curl tubes 30. To this end, as shown in FIG. 6, each ribbon strand is directed into a separate tension path 43. In the present instance, each tension path is disposed at an angle of 45° to the longitudinal axis of the tension regulator unit 42.

The tension path 43 is defined by an elevated entry guide 46, an elevated exit guide 48 and a weight roller 47 therebetween. The strand is guided over the entrance guide 46 under the roller 47 and over the exit guide 48 and then is allowed to advance longitudinally of the unit 42 to the exit end 50 at the righthand end of the tension unit frame 45. The weight roller 47 suspended on the loop of the stand between the entrance guide 46 and exit guide 48 maintain sufficient tension on the strand to overcome its tendency to curl, avoiding tangles of the strands in the tension regulator unit 42.

As shown in FIG. 1, each strand 14 is directed from its associated curling tube to a tension path 43 in the unit 42. As a strand 14 is paid out through the feed rolls 22, it travels into the tension regulator unit 43 where its tension is maintained by the weight of the roller 47. The height of the guides 46 and 48 above the floor of the unit 42 is sufficient to allow an accumulation of a length of approximately twice the height of the unit within each tension path 43 of the tension regulator unit. In order to meter the desired accumulation of the individual strands in the unit 42, the weight roller 47 is coupled to a sensor unit which senses the vertical position of the weight roller 47 between the guides 46 and 48. The sensor, in turn, is coupled to the control circuit 24 for the feed rollers controlling the feed of the strand to that particular tension path so that when the weight is raised by the discharge of the strand to the exit end 50 from the tension path 43, the feed rollers for that strand will be activated when the weight roller 47 reaches an upper limit position 55 (see FIG. 1). Activating the feed rollers 22 for that strand will cause an additional length of strand to be paid out into the tension path 43 from the associated curl tube 30, thereby causing the weight roller to fall to accommodate the longer length of ribbon between the entry and exit guides 46 and 48. When the accumulation of the ribbon strand in the tension path 43 is sufficient, the weight roller drops to its lower limit position 57 and the sensor associated with the weight roller signals the controller 24 to arrest the advance of the feed rollers 22. Thus, the tension regulator unit 42 meters the accumulation of a sufficient length of each strand within the unit 42 at all times.

The angular orientation of the tension path 43 in the unit enables the plurality, in the present instance twelve strands 14 to be fed to the entry guides 46 in spaced parallel array, as shown in FIG. 1. The strands exiting the tension path 43 at the exit guides 48 are advanced from the exit end of the tension regulator unit and are stacked one upon the other in face-to-face confronting relation in a stacker shown diagrammatically at 51 in the packaging unit 65.

In the illustrated embodiment, a single stacker is shown diagrammatically at 51 which will stack all twelve ribbons to form a twelve-layer stack. However, additional stackers may be added to form plural stacks of less than twelve strands. The stacker 51 is at the entrance end of the packaging unit 65 and includes a clamp to immobilize the stack with the leading ends of the ribbon strands projecting into the packaging unit.

Figure 7:
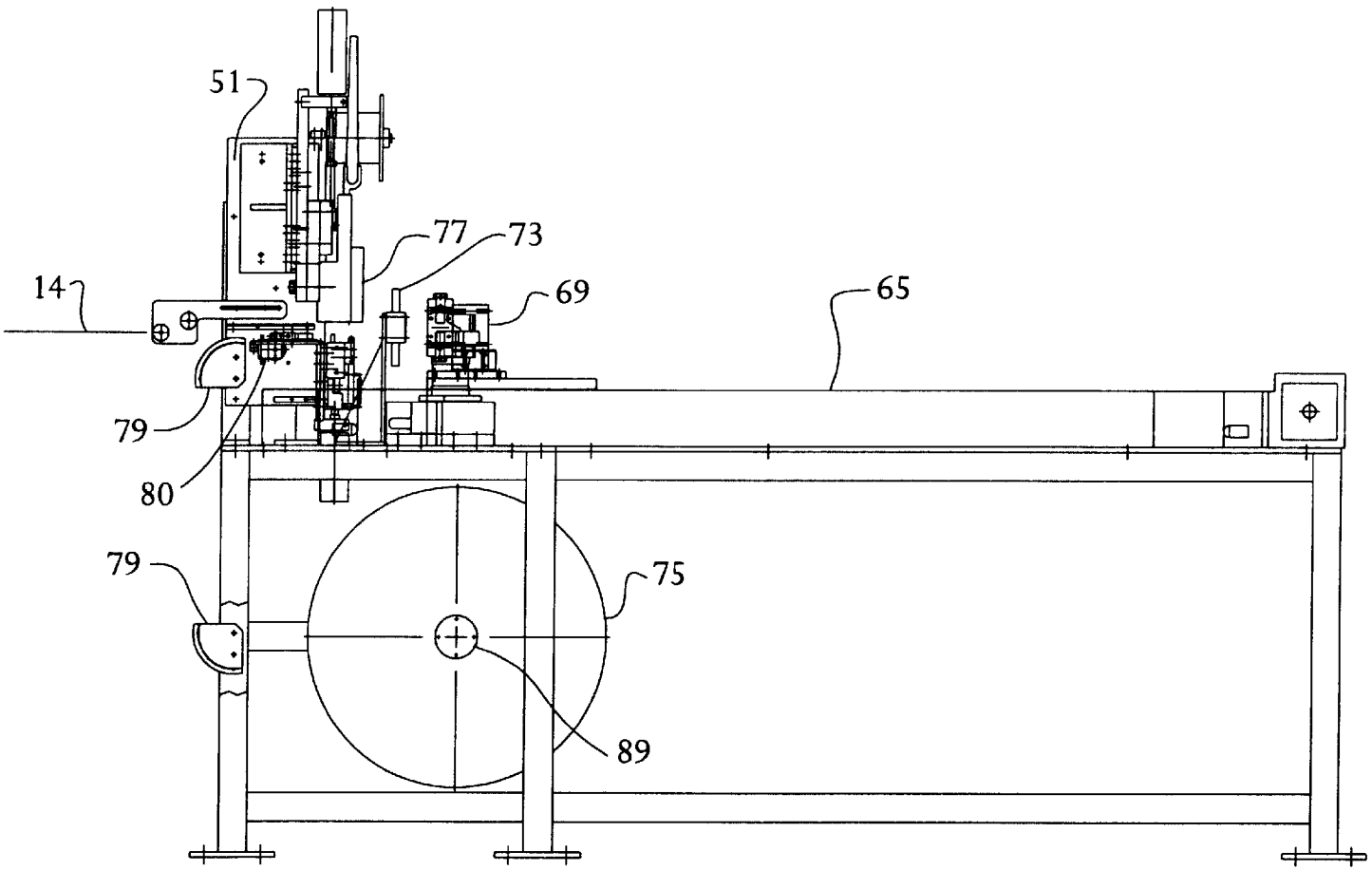
FIG. 7 is an enlarged side view of the packaging unit of the apparatus illustrated in FIG. 1.

The packaging unit 65 operates to withdraw a first part of a predetermined length of the stacked ribbons from the stacking unit 51, attach a placard to the stack of ribbon strands in the middle of the predetermined length, and then to withdraw the remaining part of the predetermined length of the stack and release the same to allow the ribbon strands in the stack to curl up and form a decorative element. To this end, as shown in FIG. 7, the packaging unit has a roll of placard material 75 journaled for rotation on a spindle 89 in the lower part of the unit 65. The placard material is guided at 79,79 from the roll 75 into a placard feed mechanism 80 associated with a stapler 77 having an anvil for attaching a placard to the stack. The stack of ribbon strands 14 is fed past the anvil of the stapler 77 over the placard material fed thereto, and the stacker 51 clamps the stack in place with the free leading end of the stack of exposed.

A gripper arm 69 is provided to grip the free end of the stack of ribbon strands and to withdraw the stack of strands past the anvil through the mouth of the stapler. The gripper arm 69 is designed to withdraw a predetermined length of the stacked ribbon strands past the anvil of the stapler 77 and the operation is accomplished in two stages. In the first stage, the gripper withdraws approximately one half of the predetermined length of the stacked ribbons past the anvil of the stapler and is arrested while the stapler 77 is actuated to attach the ribbons to the placard which has previously been fed to the stapler. The clamp of the stacker 51 is operated in timed relation to the gripper arm 69 to release the stack when the gripper withdraws the stack from the stapler 77. After the stapling operation, the gripper 69 withdraws the remainder of the predetermined length past the stapler anvil, and a cutter mechanism 73 operates to separate the predetermined length of stacked ribbons from the continuous length of ribbons projecting from the stacker. Prior to the severing, the predetermined length of stacked strands extends from the stapler 77 to the withdrawn gripper 69 at the righthand end of the packaging unit. When the predetermined length is severed, the gripper 69 releases its grip on the stacked strands and the individual strands in the stack stapled to the placard are then free to curl upon themselves and form a decorative element stapled to the placard.

The longitudinal displacement or throw of the gripper 69 corresponds to the predetermined length of the strands in the decorative element formed in the packaging unit, which in turn correspond to the metered length strands accumulated in the tension regulator 42. When the gripper releases its grip on the strands concurrently with the severing of the opposite end of the stack, the placard with the ribbons attached may drop onto a conveyor for incorporation in packaging for the consumer.

Although a single embodiment has been described and illustrated in this application, it is not intended to limit the invention as disclosed, but changes and modifications may be made therein and thereto within the scope of the following claims.

What is claimed is:

1. Apparatus for creating a decorative element with a curled ribbon, comprising:

means for supplying at least one strand of ribbon having a flat face;

a ribbon drive for advancing the ribbon strand from said supply through the apparatus;

a curling tube having circumferential generally cylindrical exterior defining a helical ribbon path around the curling tube exterior, said path having a first and a second part;

guide means for directing the ribbon strand along said helical ribbon path with said flat face wrapped around the exterior of the curling tube, means for heating said ribbon strand during passage along said first part of said helical path defined by said curling tube cylindrical exterior and for cooling said ribbon strand during passage along said second part of said helical path defined by said curling tube cylindrical exterior, said heating and cooling of said ribbon while wrapped around said tube imparting to the ribbon a tendency to curl;

a tension regulator receiving the ribbon strand discharged from said helical path, said tension regulator having a sensing device responsive to the accumulation of ribbon in said regulator and coupled to said ribbon drive for controlling the actuation of said ribbon drive; and a packaging unit including:

means for withdrawing a predetermined length of said strand of ribbon from the tension regulator;

means for feeding a placard into said packaging unit;

means for attaching a mid-portion of said predetermined length to said placard; and a ribbon cutting means for detaching said predetermined length from the remainder of said ribbon strand in said tension regulator and allowing said ribbon to curl to form a decorative element.

2. Apparatus for creating a decorative element with a curled ribbon according to claim 1 wherein said guide means comprises a helical fin wrapped around said curling tube to define a helical groove producing said helical ribbon path.

3. Apparatus for creating a decorative element with a curled ribbon according to claim 2 wherein said curling tube is hollow with a series of apertures communicating the hollow interior of said tube with the helical groove produced by said fin, and including a plug in said hollow interior of the tube to separate the first part of the path from the second part, and means to supply temperature-controlled air to said hollow interior on opposite sides of the plug to blow heating air to said first part of the path and cooling air to said second part of the path.

4. Apparatus for curling a ribbon strand having at least one flat face, comprising:

a curling tube having a generally cylindrical exterior defining a circumferential helical ribbon path, around the curling tube exterior, said path having a first and a second part;

a helical fin wrapped around said tube exterior to define said ribbon path and constituting guide means for directing the ribbon strand along and maintaining the ribbon strand in said helical ribbon path with said flat face wrapped around the exterior of the curling tube, means for supplying air against said ribbon strand to heat said ribbon strand in said first part of the path and cooling air against ribbon strand to cool said ribbon strand while in said second part of the path, said heating and cooling of said ribbon by application of heating and cooling air thereto while wrapped around said tube imparting to the ribbon a tendency to curl;

a tension regulator receiving the ribbon strand discharged from said helical path, and a ribbon cutting means for detaching a predetermined length of said strand from the remainder of said predetermined length of ribbon strand to allow said ribbon to curl to form a decorative element.

5. Apparatus for creating a decorative element with a curled ribbon according to claim 4, said curling tube being hollow with a series of apertures communicating the hollow interior of said tube with the helical ribbon path defined by said fin, and including a plug in said hollow interior of the tube to separate the first part of the path from the second part, said means to supply heating air and cooling air being connected to said hollow interior on opposite sides of said plug to blow heating air to said first part of the path at one side of the plug, and cooling air to said second part of the path on the opposite side of the plug.

6. Apparatus for creating a decorative element having a plurality of strands of curled ribbon, comprising:

means for supplying plural strands of ribbon, each strand having a pair of oppositely outwardly facing flat surfaces;

a ribbon drive for advancing the plural ribbon strands from said supply through the apparatus;

a curling tube for each strand, each tube having a circumferential generally cylindrical exterior defining a helical ribbon path around the curling tube exterior, said path having a first and a second part;

guide means for directing each ribbon strand along the helical ribbon path of its associated curling tube, with one of said flat faces wrapped around the exterior of the curling tube, means for heating said ribbon strand during ribbon travel along said first part of the path and for cooling said ribbon strand during ribbon travel along said second part of the path, said heating and cooling of said ribbon while wrapped around said tube the ribbon a tendency to curl;

a tension regulator for receiving the ribbon strands exiting from said helical paths and combining said strands face-to-face into a stack with the flat faces in confronting one another, and a packaging unit comprising:

means for withdrawing a predetermined length of said stacked strands of ribbon from the tension regulator;

means for feeding a placard into said packaging unit;

means for attaching a mid-portion of said predetermined length to said placard; and a ribbon cutting means for detaching said predetermined length from the remainder of said ribbon strands and allowing said ribbon strands to curl to form a decorative element.

7. An apparatus for curling ribbon, comprising:

means for supplying at least one strand of ribbon;

a ribbon drive for advancing the ribbon strand from said supply;

a curling tube, the tube having a guide formed on the exterior surface, the guide defining a helical path around the exterior of the tube, said path having a first and second part, the guide directing the ribbon strand around exterior surface of the tube along the helical path;

means for heating the curling tube exterior within the first part of the path;

means for cooling the curling tube exterior within the second part of the path while the curling tube exterior within the first part of the path is being heated by said heating means;

the heating and then cooling of the ribbon strand directed by the guide within the path imparting to the ribbon a tendency to curl.

8. An apparatus as claimed in claim 7 further comprising a tension regulator for receiving the ribbon strand from the second part of the path, said tension regulator having a sensing device responsive to the accumulation of ribbon in said regulator and coupled to said ribbon drive for controlling the actuation of said ribbon drive.

9. An apparatus as claimed in claim 8 further comprising a packaging unit, said packaging unit having means for withdrawing a predetermined length of ribbon strand from the tension regulator; means for feeding a placard into said packaging unit; means for attaching a mid-portion of said predetermined ribbon length to said placard; and ribbon cutting means for detaching said predetermined length from the remainder of said ribbon strand in said tension regulator and allowing said ribbon to curl to form a decorative element.

10. An apparatus as claimed in claim 7 wherein the heating means comprises means for heating air and directing it through the interior of the tube adjacent the first part of the helical path.

11. An apparatus for curling ribbon, comprising:

means for supplying at least one strand of ribbon;

a ribbon drive for advancing the ribbon strand from said supply;

a curling tube, the tube having a guide formed on the exterior surface, the guide defining a helical path around the exterior of the tube, said path having a first and second part, the guide directing the ribbon strand around exterior surface of the tube along the helical path;

means for heating the curling tube exterior within the first part of the path, the heating means comprising means for heating air and directing it through the interior of the tube adjacent the first part of the helical path;

means for cooling the curling tube exterior within the second part of the path, the cooling means comprising means for directing non-heated air through the interior of the tube adjacent the second part of the helical path;

the heating and then cooling of the ribbon strand directed by the guide within the path imparting to the ribbon a tendency to curl.

12. An apparatus as claimed in claim 10 wherein the heating means further comprises a series of openings in the exterior surface of the tube within the first part of the path, the openings directing at a series of spaced locations the heated air from the interior of the tube into the ribbon strand as it passes through the first part of the path.

13. An apparatus for curling ribbon, comprising:

means for supplying at least one strand of ribbon;

a ribbon drive for advancing the ribbon strand from said supply;

a curling tube, the tube having a guide formed on the exterior surface, the guide defining a helical path around the exterior of the tube, said path having a first and second part, the guide directing the ribbon strand around exterior surface of the tube along the helical path;

means for heating the curling tube exterior within the first part of the path, the heating means comprising means for heating air and directing it through the interior of the tube adjacent the first part of the helical path, the heating means further comprising a series of openings in the exterior surface of the tube within the first part of the path, the openings directing at a series of spaced locations the heated air from the interior of the tube into the ribbon strand as it passes through the first part of the path;

means for cooling the curling tube exterior within the second part of the path, the cooling means comprising means for directing non-heated air through the interior of the tube adjacent the second part of the helical path for cooling the ribbon heated by the heating means in the first part of the path;

the heating and then cooling of the ribbon strand directed by the guide within the path imparting to the ribbon a tendency to curl.

14. An apparatus as claimed in claim 13 wherein the cooling means further comprises a series of openings in the exterior surface of the tube within the second part of the path, the openings directing at a series of spaced locations the non-heated air from the interior of the tube into the ribbon strand as it passes through the second part of the path.

15. An apparatus for creating curled ribbon, comprising:

means for supplying a plurality of ribbon strands;

a ribbon drive for advancing the ribbon strands from said supply;

a series of curling tubes for receiving at least a portion of the plurality of ribbon strands, each of the tubes having a defined path for guiding the ribbon strand along the exterior of the tube, the defined path having a first part and a second part, means for heating the curling tube exterior within the first part of the path;

means for cooling the curling tube exterior within the second part of the path while the curling tube exterior within the first part of the path is being heated by said heating means;

said heating and then cooling of the ribbon strand within the first and second parts of the path imparting to the ribbon a tendency to curl.

16. An apparatus as claimed in claim 15 further comprising a tension regulator for receiving the series of ribbon strand from the second part of the path, said tension regulator having a sensing device responsive to the accumulation of ribbon in said regulator and coupled to said ribbon drive for controlling the actuation of said ribbon drive.

17. An apparatus as claimed in claim 15 further comprising a packaging unit, said packaging unit having means for withdrawing a predetermined length of at least a portion of the plurality of ribbon strands after passage thereof over the curling tubes; means for feeding a placard into said packaging unit; means for attaching a mid-portion of said predetermined ribbon lengths to said placard; and ribbon cutting means for detaching said predetermined lengths of ribbon from the remainder of said ribbon strands and allowing said ribbon to curl to form a decorative element.

18. An apparatus as claimed in claim 17 wherein the heating means comprises means for heating air and directing it through the interior of the series of tubes within the first part of the path; and a series of openings in the exterior surface of the tube within the first part of the path, the openings directing at a series of spaced locations the heated air from the interior of the tube into the ribbon strand as it passes along the first part of the path.

19. An apparatus for creating curled ribbon, comprising:

means for supplying a plurality of ribbon strands;

a ribbon drive for advancing the ribbon strands from said supply;

a series of curling tubes for receiving at least a portion of the plurality of ribbon strands, each of the tubes having a defined path for guiding the ribbon strand along the exterior of the tube, the defined path having a first part and a second part, means for heating the curling tube exterior within the first part of the path, the heating means comprising means for heating air and directing it through the interior of the series of tubes within the first part of the path; and a series of openings in the exterior surface of the tube within the first part of the path, the openings directing at a series of spaced locations the heated air from the interior of the tube into the ribbon strand as it passes along the first part of the path;

means for cooling the curling tube exterior within the second part of the path, the cooling means comprising means for directing non-heated air through the interior of the tube within the second part of the path; and a series of openings in the exterior surface of the tube within the second part of the path, the openings directing at a series of locations the non-heated air from within the interior of the tube into the ribbon strand as it passes through the second part of the path;

said heating and then cooling of the ribbon strand within the first and second parts of the path imparting to the ribbon a tendency to curl;

a packaging unit having means for withdrawing a predetermined length of at least a portion of the plurality of ribbon strands after passage thereof over the curling tubes;

means for feeding a placard into said packaging unit;

means for attaching a mid-portion of said predetermined ribbon lengths to said placard; and ribbon cutting means for detaching said predetermined lengths of ribbon from the remainder of said ribbon strands and allowing said ribbon to curl to form a decorative element.

20. An apparatus as claimed in claim 19 wherein the interior of the tube within the first part of the path and the interior of the tube within the second part of the path are separated by a baffle.

21. An apparatus for curling ribbon comprising:

an elongated curl member having first and second portions, said curl member further having a guide formed on an exterior surface of said curl member defining a helical ribbon path extending along the first and second portions of said curl member;

a ribbon drive for advancing a strand of ribbon along said ribbon path from the first portion of said curl member to the second portion of said curl member; and a source of heat operably connected to the first portion of said curl member for raising the temperature of said ribbon above a predetermined temperature for said ribbon whereby a helical set will be induced in said ribbon; and a heat transfer barrier between the first and second portions of said curl member for limiting heat transfer from said first portion to said second portion such that said ribbon is capable of being cooled in said second portion of said curl member to a temperature sufficiently below said predetermined temperature such that the helical set in said ribbon is fixed.

22. The apparatus according to claim 21 wherein the first portion of said curl member includes a hollow interior and wherein said source of heat comprises a heat transfer medium which is directed within said hollow interior.

23. The apparatus according to claim 22 wherein said curl member comprises a tube having a hollow interior extending along the first and second portions of said curl member and wherein said heat transfer medium consists of heated air, said heat transfer barrier including a plug positioned within the hollow interior of said tube to limit passage of said heated air within the interior from the first portion of said tube to the second portion of said tube.

24. The apparatus according to claim 23 further including a source of non-heated air operably connected to the second portion of said tube such that non-heated air is directed into the hollow interior within said second portion.

25. The apparatus according to claim 24 wherein the tube includes openings in the first and second portions for directing said heated air and said non-heated air from the hollow interior of said first and second portions to the exterior surface of said first and second portions.

26. An apparatus for creating a curl in a strand of ribbon, comprising:

a curling tube having an exterior surface, the tube having a guide formed on the exterior surface defining a helical path around the exterior of the tube for directing the ribbon strand, the helical path having a length that includes first and second portions;

means for heating only to the first portion of the helical path length to elevate the temperature of the first portion above the temperature of the second portion thereby creating relatively hot and cold portions of the helical path length;

means for advancing the strand of ribbon along the helical path through the hot and cold portions of the helical path length, the advancement of the ribbon strand through the hot and cold portions tending to induce and then fix a curl in the ribbon strand.

27. The apparatus according to claim 26 wherein the heating means comprises means for heating air and directing it through the interior of the tube adjacent the first portion of the helical path length.

* * * * *